US006915747B1

(12) United States Patent
Sewell

(10) Patent No.: US 6,915,747 B1
(45) Date of Patent: Jul. 12, 2005

(54) WRAPPED DECK PALLET FORMED OF TWO ORTHOGONALLY RELATED CARDBOARD SHEETS AND METHOD

(76) Inventor: James D. Sewell, 11389 Trade Center Dr., Rancho Cordova, CA (US) 95741

( * ) Notice: Subject to any disclaimer, the term of this patent is extended or adjusted under 35 U.S.C. 154(b) by 0 days.

(21) Appl. No.: 10/125,813

(22) Filed: Apr. 17, 2002

Related U.S. Application Data

(63) Continuation-in-part of application No. 09/797,933, filed on Mar. 2, 2001, now Pat. No. 6,739,270.

(51) Int. Cl.[7] ..... B65D 19/00
(52) U.S. Cl. ..... 108/51.3
(58) Field of Search ..... 108/51.3, 51.11, 108/57.34

(56) References Cited

U.S. PATENT DOCUMENTS 2,925,947 A * 2/1960 Brown ..... 108/51.3
3,302,593 A * 2/1967 Roberts ..... 108/51.3
3,952,672 A * 4/1976 Gordon et al. ..... 108/51.3
5,207,631 A * 5/1993 Schmidtke et al. ..... 108/51.3
RE35,131 * 12/1995 Youell et al. ..... 108/51.3
5,483,875 A * 1/1996 Turecek et al. ..... 108/51.3
5,881,652 A * 3/1999 Besaw ..... 108/51.3
5,934,202 A * 8/1999 Lai ..... 108/51.3
6,076,475 A * 6/2000 Kuhn et al. ..... 108/51.3
6,079,337 A * 6/2000 Huang et al. ..... 108/56.3

* cited by examiner

*Primary Examiner*—Jose V. Chen
(74) *Attorney, Agent, or Firm*—Bernhard Kreten

(57) ABSTRACT

A cardboard pallet that is constructed of a laminate, such that the top and bottom of the pallet have two plies of material, with the plies mutually orthogonal to one another. The pallet is assembled by attaching stringers and ribs to an inner skin, rotating the inner skin 90° and attaching to an outer skin, and wrapping the inner and outer skins about the stringers. Apertures on the end regions and portals in the bottom region of the pallet accommodate forklift tines or wheels on various material-handling devices. The apertures may be formed to create wear cuffs, to lengthen the life of the pallet.

58 Claims, 14 Drawing Sheets

WRAPPED DECK PALLET FORMED OF TWO ORTHOGONALLY RELATED CARDBOARD SHEETS AND METHOD

This application is a continuation-in-part of application Ser. No. 09/797,933, filed Mar. 2, 2001, now U.S. Pat. No. 6,739,270.

FIELD OF THE INVENTION

The following invention is generally related to instrumentalities and methodologies in pallets. More specifically, the instant invention is directed to a method and apparatus for forming a pallet from two orthogonally-related sheets of cardboard.

BACKGROUND OF THE INVENTION

Traditionally, pallets have been made from pieces of wood which have been nailed together. The use of wood pallets has created a multitude of problems in the industry. They are heavy, expensive to transport, not amenable to recycling, and have a limited lifetime. When goods are shipped on pallets, the recipient of those goods is made to bear the expense of returning the pallets to the sender, which may cut severely into the recipient's profit margin. Certainly, pallets may be reused, but their life expectancy is disappointingly short when compared to the costs they engender during their limited time of usefulness. Construction of pallets uses valuable raw materials, with little or no hope of recycling once the pallet's life has run its course. Many dispose of used pallets in landfills, but with so many landfills already filled to capacity, premium charges are levied against such disposers of pallets past their prime.

The patent literature, aware of the problems of using wood, is fairly rich in teachings related to pallets made from materials other than wood, such as cardboard. These teachings, however, have met with modest commercial success, despite the apparent advantages associated with cardboard. The problems common to this category include cost of production, durability and the ability to withstand the loads imposed on the pallet during use which is typically quite severe.

The following prior art reflects the state of the art of which applicant is aware and is included herewith to discharge applicant's acknowledged duty to disclose relevant prior art.

| INVENTOR | PATENT NO. | ISSUE DATE |
|---|---|---|
| Fallert | 2,388,730 | Nov. 3, 1945 |
| Cahners | 2,444,183 | Jun. 29, 1948 |
| Fallert, et al. | 2,446,914 | Aug. 10, 1948 |
| Farrell | 2,576,715 | Nov. 27, 1951 |
| Norquist, et al. | 2,957,668 | Oct. 25, 1960 |
| Sorensen, et al. | 2,996,276 | Aug. 15, 1961 |
| Doane | 3,079,876 | Mar. 5, 1963 |
| Roberts | 3,302,593 | Feb. 7, 1967 |
| Gifford | 3,464,371 | Sep. 2, 1969 |
| Geschwender | 3,587,479 | Jun. 28, 1971 |
| Neitzke | 3,628,469 | Dec. 21, 1971 |
| Quaintance | 3,911,834 | Oct. 14, 1975 |
| McCulloch | 4,399,972 | Aug. 23, 1983 |
| Eatherton | 4,424,753 | Jan. 10, 1984 |
| Beckway | 4,487,136 | Dec. 11, 1984 |
| Kilpatrick, et al. | 5,355,812 | Oct. 18, 1994 |
| Hayakawa | 5,383,409 | Jan. 24, 1995 |
| Crews, et al. | 5,388,531 | Feb. 14, 1995 |
| Van Erden | 5,413,824 | May 9, 1995 |
| Boyse, et al. | 5,465,672 | Nov. 14, 1995 |

-continued

| INVENTOR | PATENT NO. | ISSUE DATE |
|---|---|---|
| Iseli | 5,528,994 | Jun. 25, 1996 |
| Taravella, et al. | 5,531,165 | Jul. 2, 1996 |
| Fiedler | 5,551,353 | Sep. 3, 1996 |
| Giasi | 5,567,263 | Oct. 22, 1996 |
| LaFreniere, et al. | 5,569,148 | Oct. 29, 1996 |
| Crews, et al. | 5,590,606 | Jan. 7, 1997 |
| Bridges, Jr. | 5,595,125 | Jan. 21, 1997 |
| Te | 5,609,557 | Mar. 11, 1997 |
| Phares, et al. | 5,672,412 | Sep. 30, 1997 |
| Tan | 5,909,712 | Jun. 8, 1999 |
| Anderson | 5,941,177 | Aug. 24, 1999 |
| Graham | 6,070,726 | Jun. 6, 2000 |
| Perazzo | 6,095,061 | Aug. 1, 2000 |

OTHER PRIOR ART—NON PATENT LITERATURE DOCUMENTS

Eagle Packaging, Inc., "Pallet Bulk Bin Flyer", Entire Flyer

Corrcycle, Inc. "Recycled Corrugated Products Brochure", Entire Brochure

Stone Container Corporation "Stone Cordeck Pallets Brochure" Entire Brochure, February 1986

Pallite Co., Inc., Flyer "Lightweight—Disposable 4 Way—Single or Double Deck Flyer", Entire Flyer, 1991

Smurfit Pallet Systems, "PayLoad Pallet Brochure", Entire Brochure

Smurfit Pallet Systems, "PayLoad II Brochure", Entire Brochure

Smurfit Pallet Systems, "PayLoad Pak Brochure", Entire Brochure

Stone Container Corporation, "Corrugated Container Brochure", Entire Brochure

Stone Container Corporation, "Stone-A-Matic Flyer", Entire Flyer

Stone Container Corporation, "Cross Docker Flyer", Entire Flyer

Stone Container Corporation, "CorDeck Brochure", Entire Brochure

SUMMARY OF THE INVENTION

The present invention is distinguishable over the prior art in a multiplicity of ways. Initially, the invention provides a method to produce a pallet that is easy to manufacture and may be recycled at the end of its useful lifetime. During its lifetime, the pallet is lightweight yet strong, and may be handled like any conventional pallet.

The pallet is constructed of a laminate, which is formed into stringers and ribs, an inner skin blank, and an outer skin blank. The stringers and ribs are formed from a stringer blank, which is die-cut and sliced into strips. This stringer blank contains body pieces and locking keys, which are used to assemble the stringers and ribs for the pallet. The body pieces are folded along score lines and placed into a rectangular shape, which has one continuous and planar edge and one crenellated edge. The crenellated edge contains grooves which receive the locking keys. The keys are inserted into the grooves until the edges are coplanar with the edges of the body pieces, providing stability and rigidity to the stringers and ribs.

The stringers and ribs are positioned on and attached to the inner skin, parallel to its long axis. The inner skin is rotated 90° and placed on the outer skin, and the inner and outer skins are wrapped about the stringers to provide a pallet that has two plies on the top and the bottom. Each end of the pallet contains apertures adapted to receive forklift tines, and the bottom of the pallet contains portals that may be suitable for wheel clearance on some material-handling devices, commonly know as "pallet jacks".

OBJECTS OF THE INVENTION

Accordingly, it is a primary object of the present invention to provide a new and novel method for forming a pallet and the pallet itself.

It is a further object of the present invention to provide a pallet that is relatively lightweight and sturdy.

It is a further object of the present invention to provide a pallet as characterized above which is simple to fabricate and easily lends itself to mass production.

It is a further object of the present invention to provide a pallet that is recyclable.

It is a further object of the present invention to provide a pallet that utilizes plural layers of cardboard with plies running perpendicular to one another for added strength.

It is a further object of the present invention to provide a pallet that is less expensive to manufacture and dispose of than conventional wooden pallets.

It is a further object of the present invention to provide a pallet that incorporates two plies on the top and bottom of the pallet for added strength.

It is a further object of the present invention to provide a pallet as characterized above wherein stringers are assembled from a pre-cut blank that is easy to produce.

It is a further object of the present invention to provide a pallet as characterized above utilizing stringers having enhanced strength from locking keys.

Viewed from a first vantage point, it is an object of the present invention to provide a pallet comprising, in combination: an inner rectangular blank, and an outer rectangular blank, said inner and outer rectangular blanks orthogonally related, said outer blank overlying said inner blank upon assembly, said inner and outer blanks providing two plies on top and bottom portions of said pallet.

Viewed from a second vantage point, it is an object of the present invention to provide a pallet comprising, in combination: an inner blank, an outer blank, and a stringer blank, said stringer blank including cutouts and scorelines adapted to conform to stringers disposed upon said inner blank and subsequently enveloped by said inner blank, and then said outer blank.

Viewed from a third vantage point, it is an object of the present invention to provide a method for forming a pallet, the steps including: forming a stringer blank to define stringers, forming an inner and an outer blank to register such that flaps of said inner blank are offset from flaps of said outer blank, and assembling said stringers to lie within said inner blank and then said outer blank.

Viewed from a fourth vantage point, it is an object of the present invention to provide a method for constructing a pallet, the steps including: forming two rectangular blanks, arranging said rectangular blanks in a cruciform pattern, said pattern including an overlapping portion and flaps, attaching stringers to said overlapping portion of said cruciform pattern formed by said rectangular blanks, parallel to the long axis of one of said rectangular blanks, wrapping said flaps of said blanks about the stringers, securing said wrapped flaps of the pallet, and punching apertures into end portions of the pallet.

These and other objects will be made manifest when considering the following detailed specification when taken in conjunction with the appended drawing figures.

DESCRIPTION OF PREFERRED EMBODIMENTS

Figure 14:
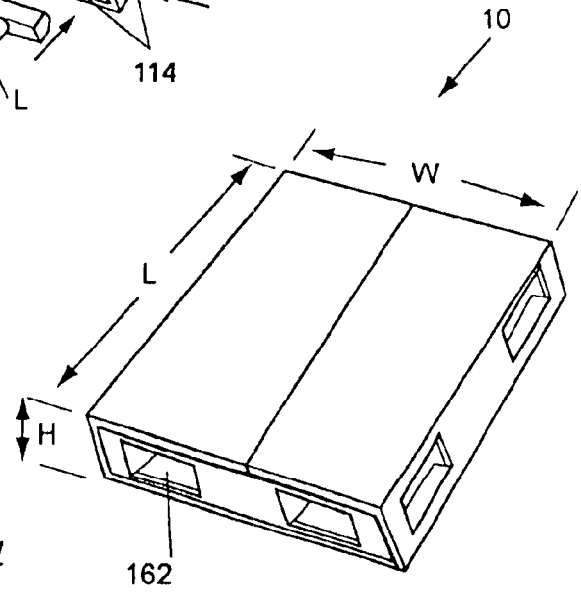
FIG. 14 is a depiction of a finished pallet containing apertures with wear cuffs.

Considering the drawings, wherein like reference numerals denote like parts throughout the various drawing figures, reference numeral 10 as shown in FIG. 14 is directed to the pallet according to the present invention. That figure defines the pallet's length L, width W and height H as well as forklift tine receiving apertures 162 mentioned hereinafter. As shown, the pallet 10 is preferably a rectangular construct.

Figure 1:
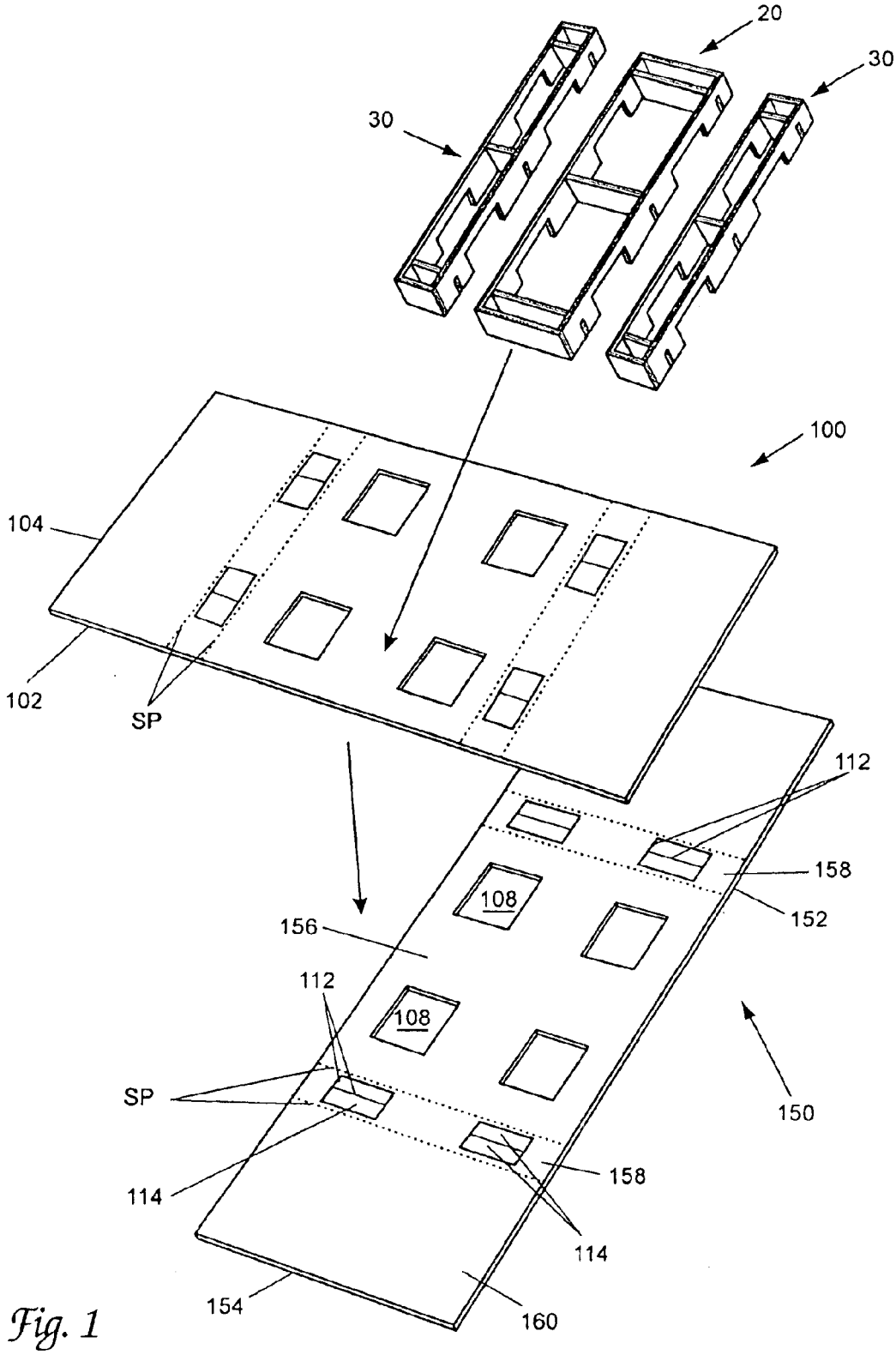
FIG. 1 is an overview of the assembly of a pallet.

In its essence, and as shown in FIG. 1, the pallet 10 includes stringers 20 and ribs 30 to be attached to an inner skin blank 100, which is then wrapped along the score lines SP. The wrapped inner skin blank is attached to an outer skin blank 150, which is similarly wrapped along the score lines SP with the inner and outer skins rotated 90° to each other relative to not only their long axis, but also preferably to their directional "grain".

Figure 2:
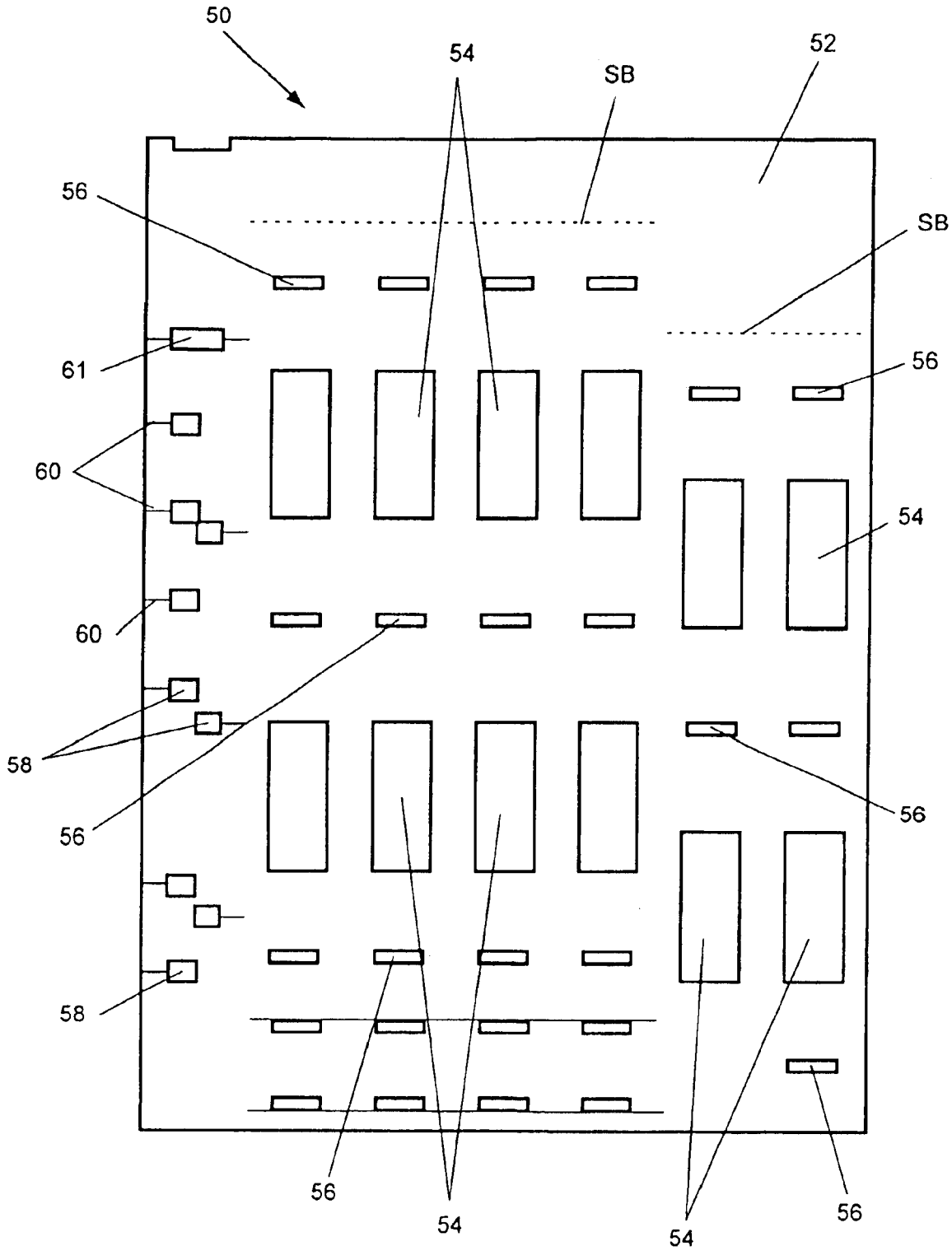
FIG. 2 is a depiction of a stringer blank and its associated cutouts.
Figure 3:
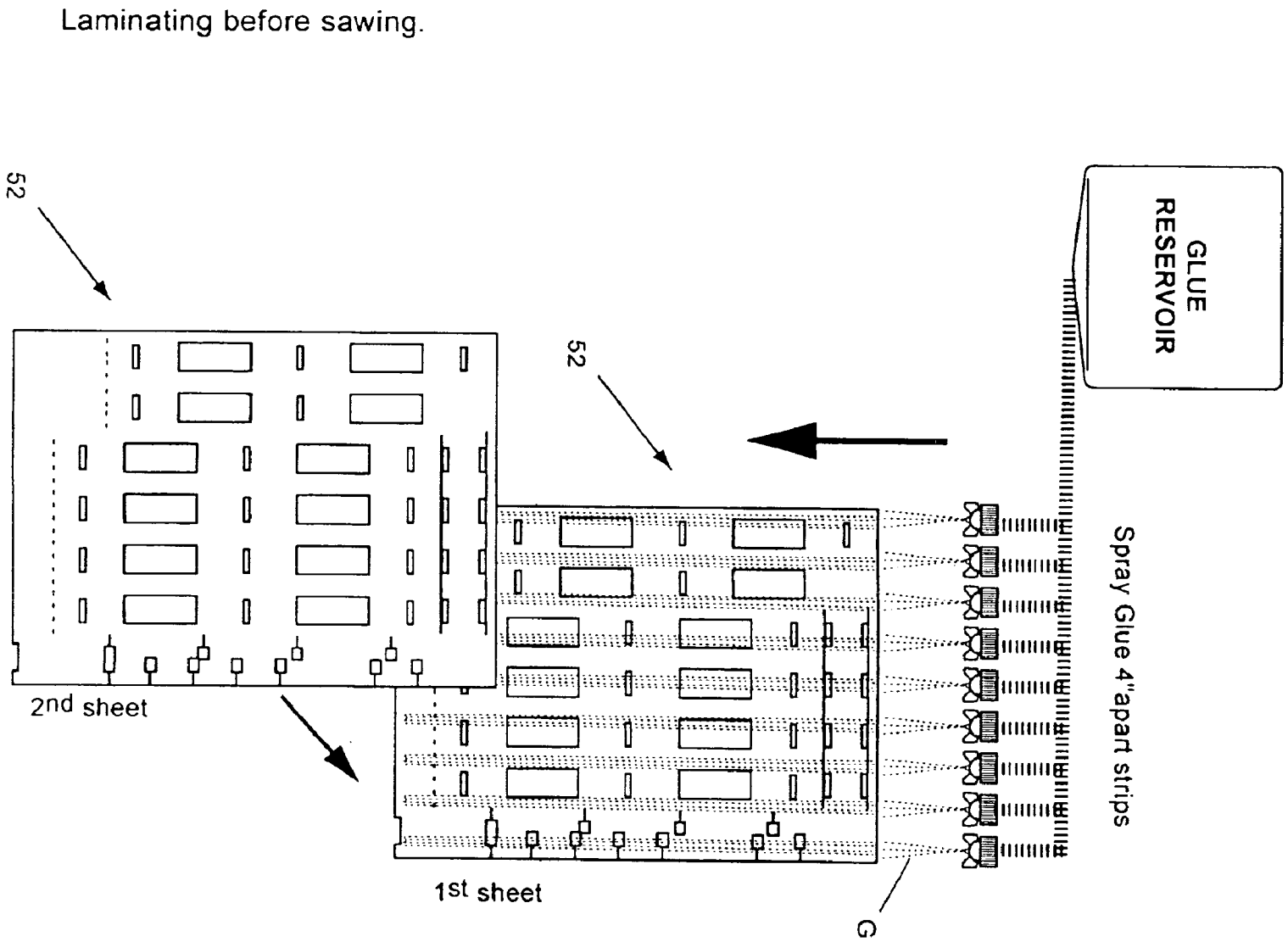
FIG. 3 is a depiction of the formation of the laminated stringer blank.

Stringers 20 and ribs 30 are preferably formed from a two ply stringer blank 50, shown in FIGS. 2 and 3, where a cardboard sheet 52 is subjected to a die-cut method in which two sets of score lines SB are formed, along with plural, similarly dimensioned windows 54, slots 56, eyes 58, slits 60, and an elongated opening 61. As shown in FIG. 3, glue G is applied in strips, preferably 4 inches apart to one side of the pre-cut sheet 52. Another pre-cut sheet 52 is placed, in the same orientation, on top of the glue G, forming the stringer blank 50, which is preferably a two ply laminate. As described infra, the two sheets 52 may preferably have their respective "grains" orientated 90° relative to each other.

Figure 4:
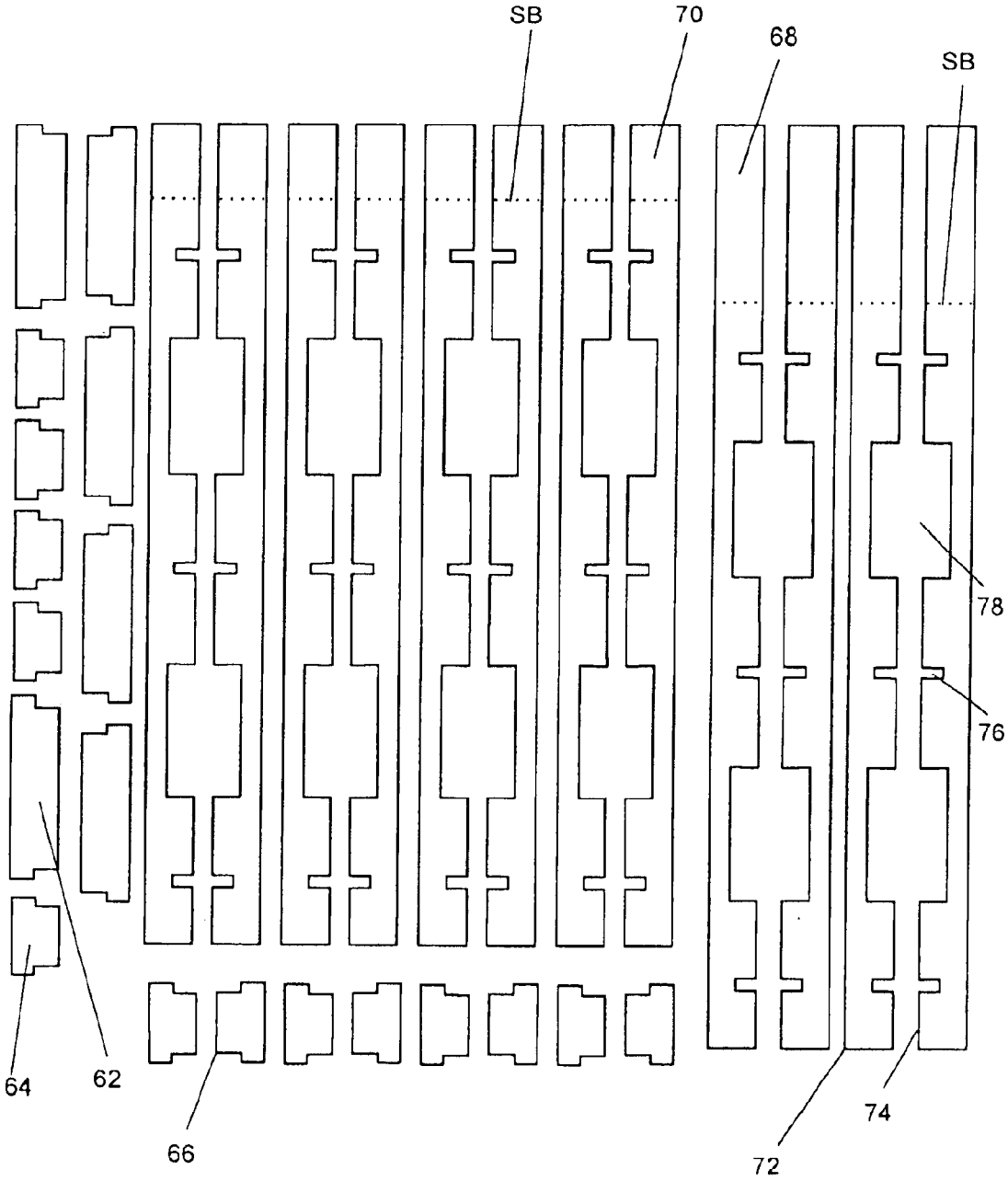
FIG. 4 is a depiction of the stringer blank after it has been cut into strips.

The stringer blank 50 is next cut into several strips, as shown in FIG. 4. The eyes 58 and the elongated opening 61, in conjunction with the slits 60, ultimately form several locking keys, in long 62 and short 64 sizes. Each key is substantially T-shaped, having two sets of parallel edges at right angles to one another, and a locking edge 66. The areas containing the slots 56 and windows 54 form two sizes of body pieces, also in long 68 and short 70 sizes. Each body piece has a continuous and planar edge 72 and a crenellated edge 74. The crenellations are formed by the bisecting of the slots 56 to form key-receiving grooves 76, and bisecting of the windows 54 to form clearance passages 78. The adjacent clearance passages 78 on each body piece 68, 70 are located a discrete distance apart from one another, consistent with the spacing on conventional forklift tines.

Figure 5:
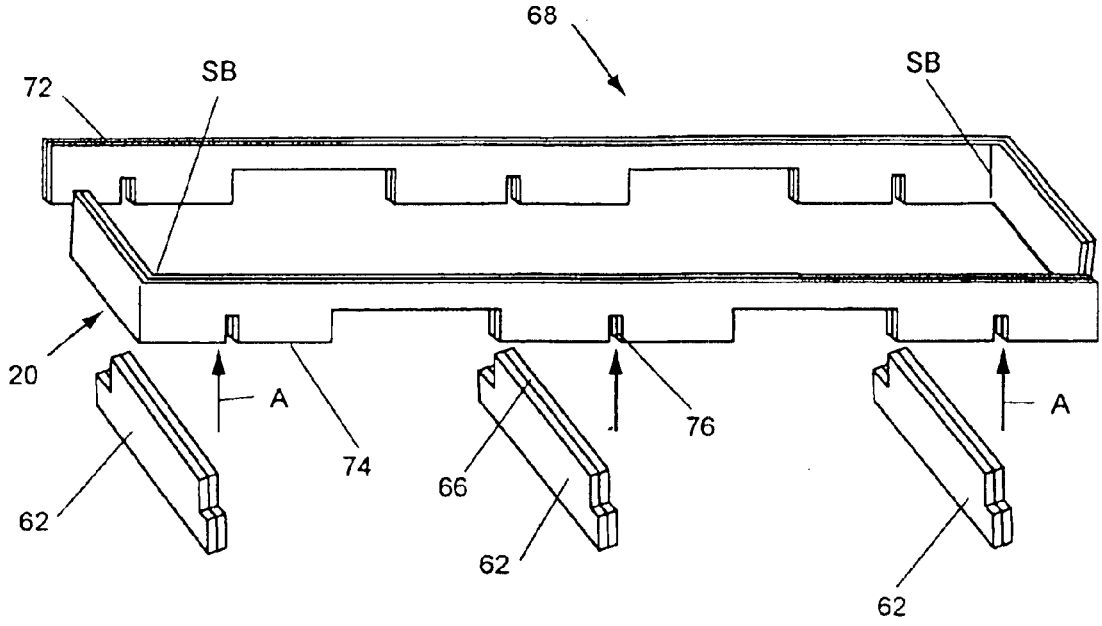
FIG. 5 is an exploded assembly view of a stringer.

Stringers 20 are formed from the long body pieces 68 and the long locking keys 62, as shown in FIG. 5. Two long body pieces 68 are identically folded along the score lines SB, and are then arranged to form a substantially rectangular shape, in which the continuous and planar edges 72 form a continuous and planar edge about the entire periphery. A long locking key 62 is inserted, locking edge 66 first, into each key-receiving groove 76 (as shown with arrow "A") such that the locking edge 66 is coplanar with respect to the continuous and planar edges 72 of the body pieces (e.g., FIG. 1). Glue may be used to assist in securing the body pieces and keys.

Figure 6:
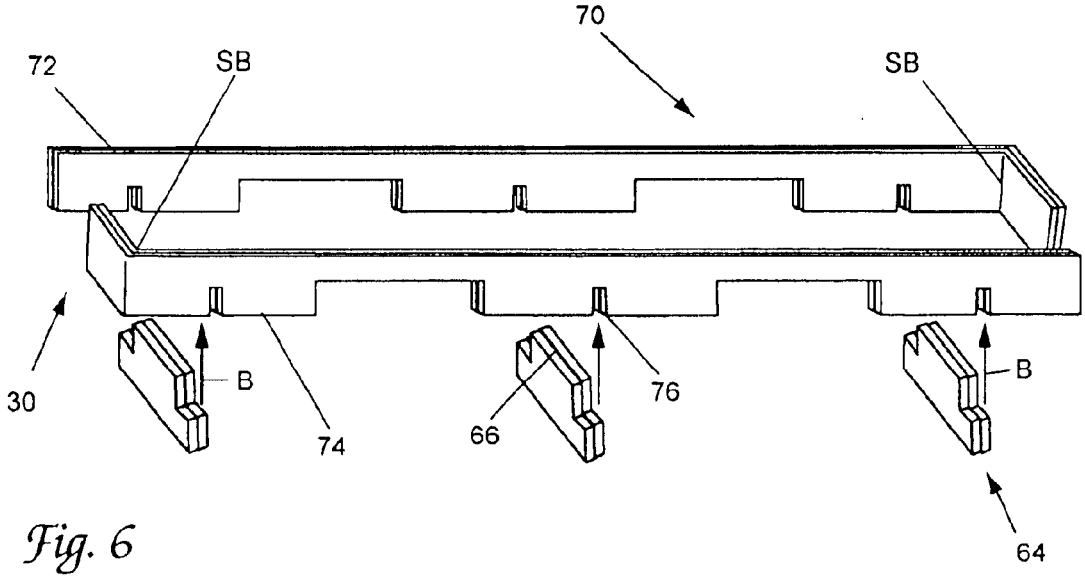
FIG. 6 is an exploded assembly view of a rib.

Similarly, ribs 30 are formed from the short body pieces 70 and the short locking keys 64, as shown in FIG. 6. Two short body pieces 70 are identically folded along the score lines SB, and are then arranged to form a substantially rectangular shape, in which the continuous and planar edges 72 form a continuous and planar edge about the entire periphery. A short locking key 64 is inserted, locking edge 66 first, into each key-receiving groove 76 (e.g., along arrow "B") such that the locking edge 66 is coplanar with respect to the continuous and planar edges 72 of the body pieces. As with stringers 20, ribs 30 can be formed with glue along contacting surfaces of keys and body pieces.

Figure 7:
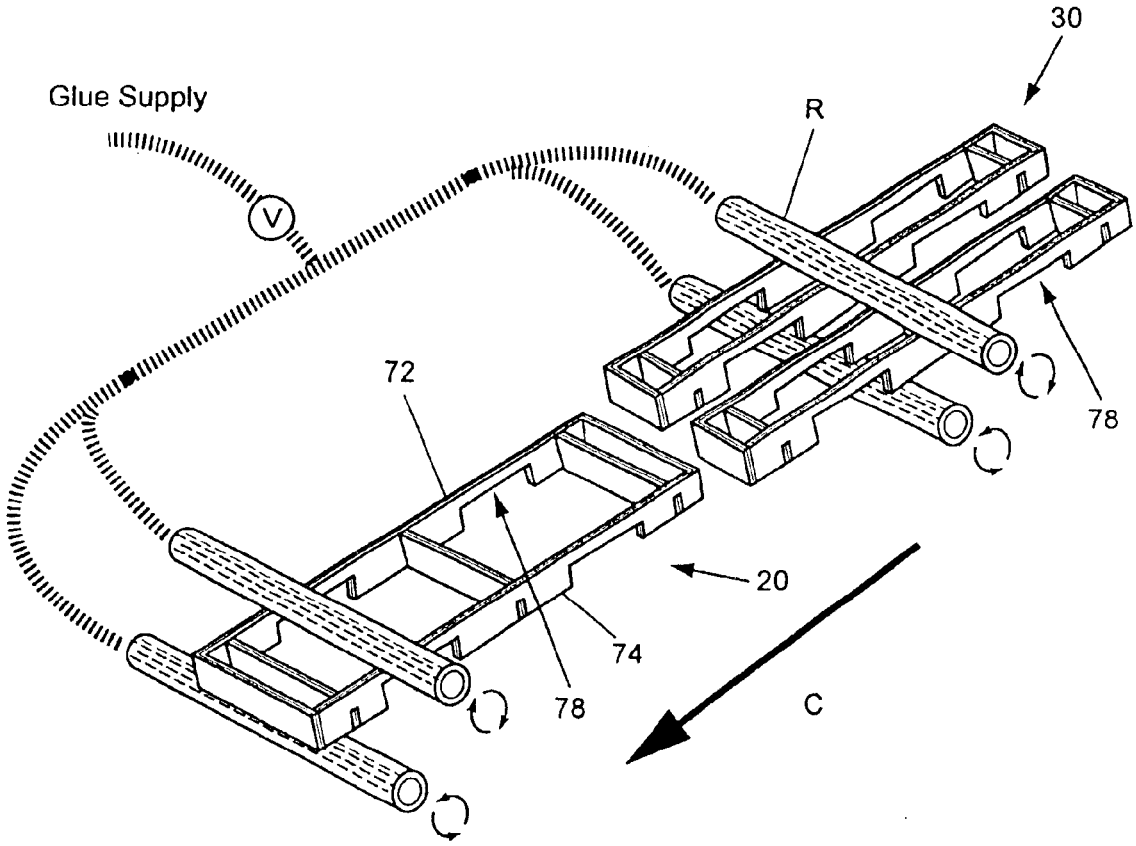
FIG. 7 is a depiction of the gluing system for the stringers and ribs.

Preferably, glue G is applied to the both the planar edges and the crenellated edges 74 of the stringers 20 and ribs 30 through rollers R, pictured in FIG. 7. Preferably, the rollers R are hollow, excreting glue radially outward at a constant rate, and are of a type that allows movement of the workpieces through an assembly line (e.g., along arrow "C"). A valve assembly V, coupled to the glue supply, would allow control of the flow rate of the glue G. It is not necessary that the clearance passages 78 receive glue.

Figure 8:
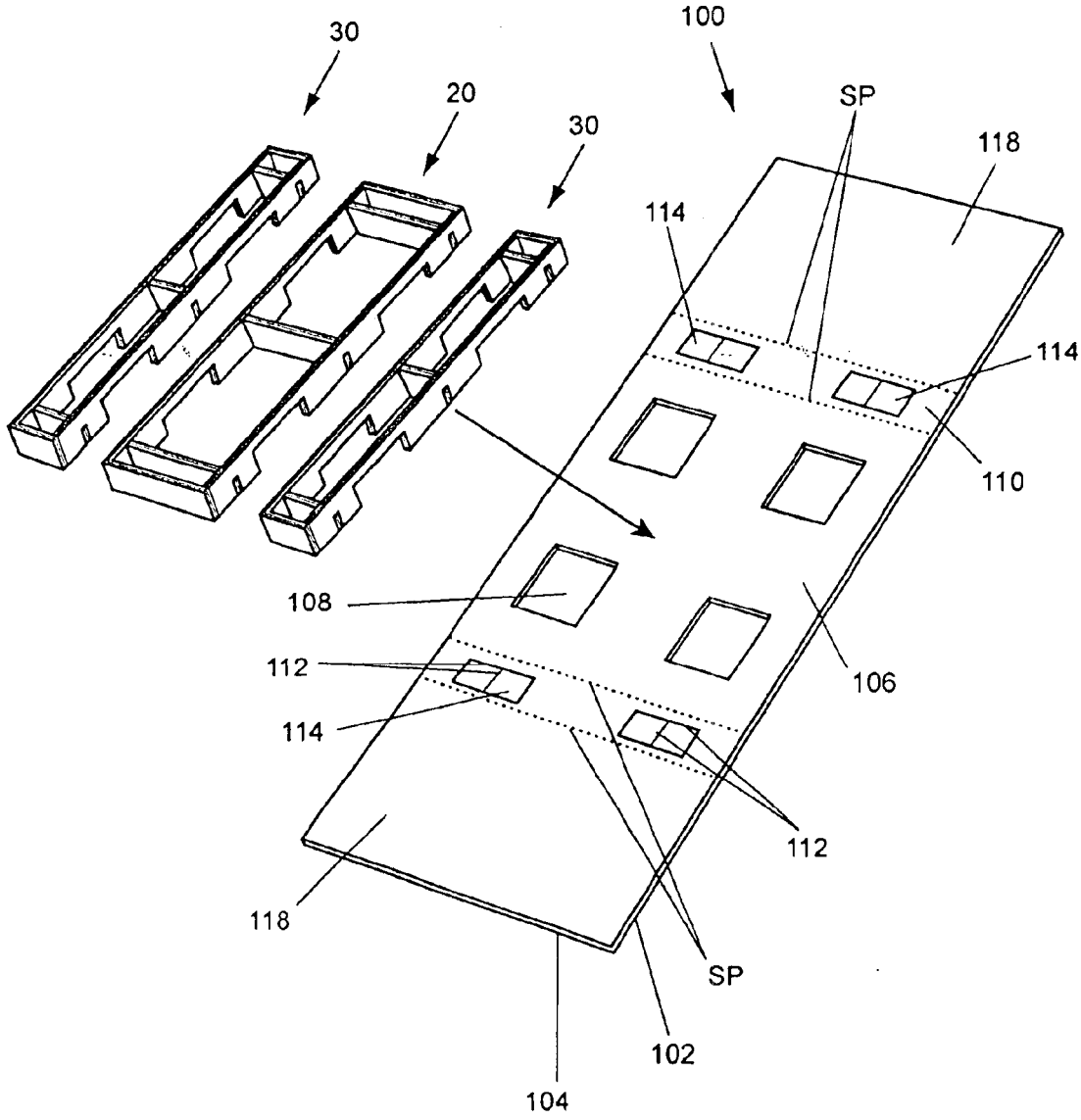
FIG. 8 shows the position of the stringers and ribs on the inner skin blank.

The inner skin blank 100, shown in FIG. 8, has a long edge 102 and a short edge 104. A die-cut process is used to produce panel-forming score lines SP, which define three distinct regions mirrored about a bisecting axis perpendicular to the long edges 102. One is a center region 106 containing four portals 108, which are rectangular and spaced equidistant from each other, with one generally located centrally in each quadrant of the center region 106. These portals 108 are placed such that diagonals bisecting the center region 108 intersect two diagonal corners of each portal 108. An end region 110, between each set of score lines SP, forms an end of a box when the inner skin blank 100 is folded along the score lines SP. These end regions 110 contain cuts 112 that define tabs 114 that become spaced a discrete distance apart, such that the tabs 114 ultimately become pushed in, defining wear cuffs surrounding the apertures 162 which receive the tines of a conventional forklift. The wear cuffs reinforce the area normally abraded by the tines and extend the useful life of the pallet. The third region defines inner flaps 118, which form the top of the box formed by folding along the score lines SP.

Figure 9:
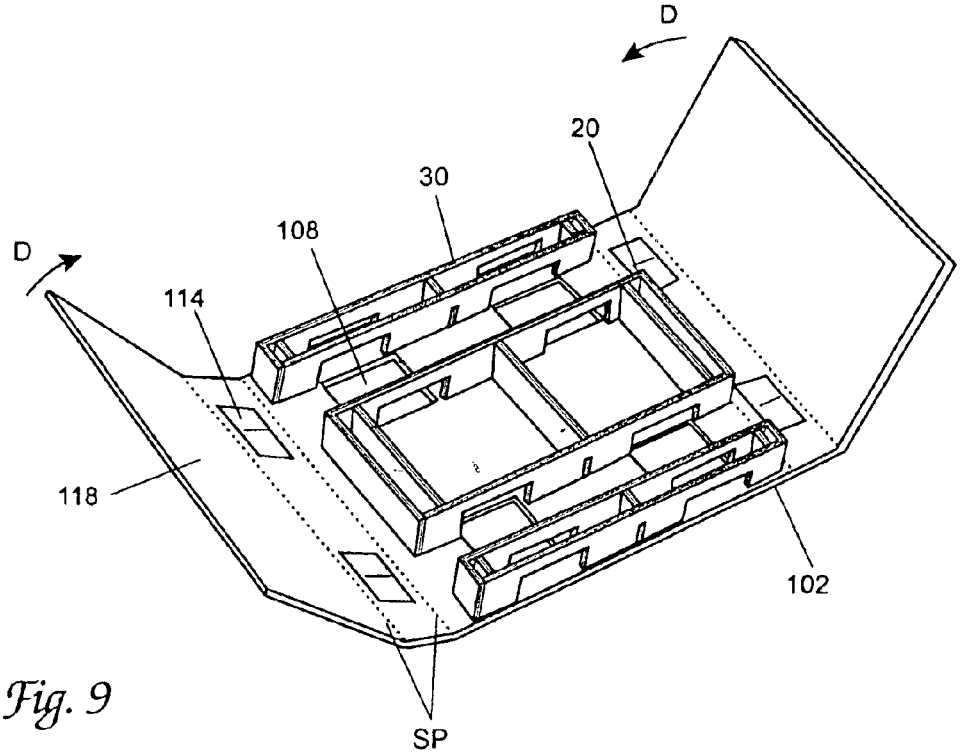
FIG. 9 depicts the wrapping of the inner skin blank about the stringers and ribs.
Figure 10:
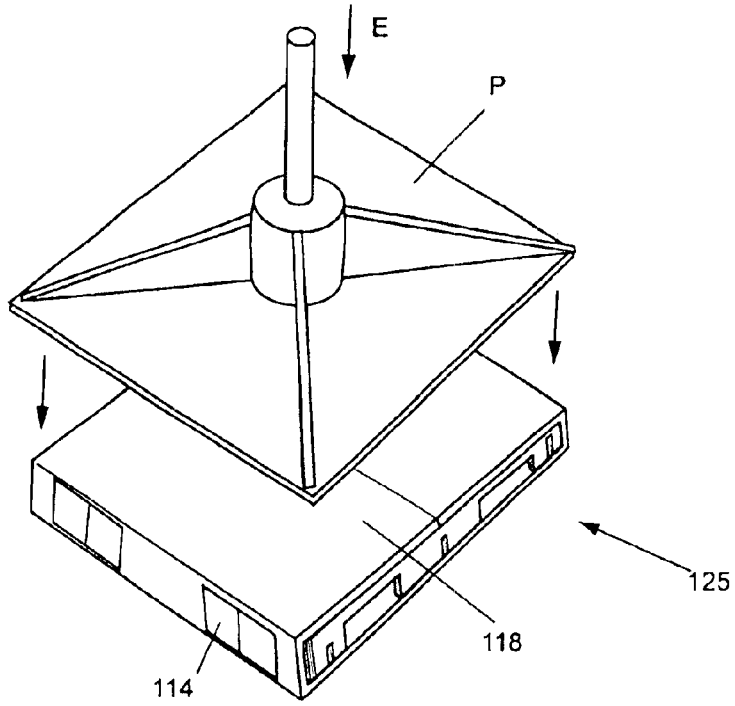
FIG. 10 shows the pressing step that secures the inner flaps.

The stringers 20 and ribs 30 are attached to the center region 106 of the inner skin blank 100 as shown in FIG. 9, parallel to the long axis 102. The ribs 30 are placed outboard, between the long edge 102 and the edges of the portals 108. A stringer 20 is placed centrally and inboard along the middle axis, parallel to the ribs 30 and the long be edge 102, and located between the portals 108. Ribs and stringer may be glued into skin 100. Glue G may also be applied to the area containing the tabs 114. The inner skin blank 100 is then folded in the direction of the arrows "D" (FIG. 9), along score lines SP, to bring the inner flaps 118 around the stringer 20 and ribs 30, to form an inner box 125 (FIG. 10). Glue can assist in holding down flaps 118. A press or platen P is used to apply force E on the inner flaps 118 fixing them in place, as shown in FIG. 10. (Note FIG. 1 reflects stringers and ribs perpendicular to the long axis as an alternative.)

Figure 11:
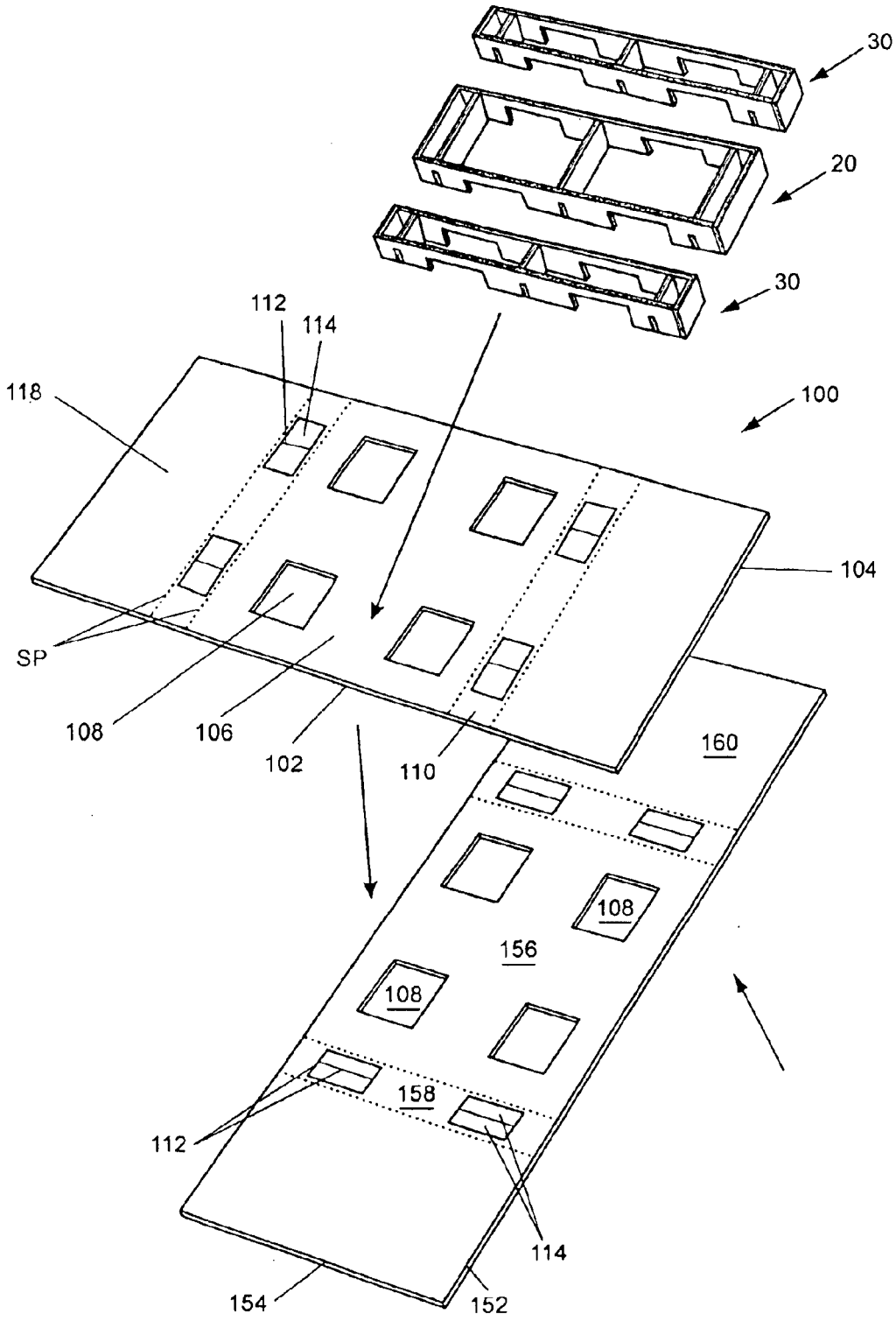
FIG. 11 shows the outer skin blank relative to the inner skin blank with the stringers and ribs.

The outer skin blank 150 (FIG. 11) has a long side 152 and a short side 154. A die-cut process is used to produce panel-forming score lines SP, which define three distinct regions mirrored about a bisecting axis perpendicular to the long sides 152. A bottom region 156, is formed in the area between the inner pair of score lines SP. The bottom region 156 contains four portals 108, which are rectangular and spaced equidistant from each other, with one in each quadrant of the bottom region 156. These portals 108 are placed such that diagonals bisecting the bottom region 156 intersect two diagonal corners of each portal 108. An end region 158, between each set of score lines SP, forms an end of a box when the outer skin blank 150 is folded along the score lines SP. Like inner skin 100, these end regions 158 contain cuts 112 that define tabs 114 that become spaced a discrete distance apart, such that the tabs 114 ultimately become pushed in, defining wear cuffs surrounding the apertures 162 which receive the tines of a conventional forklift. The regions between the outer set of score lines SP and the short sides 154 are outer flaps 160, which will form the top of the pallet 10 when assembly is complete.

Figure 12:
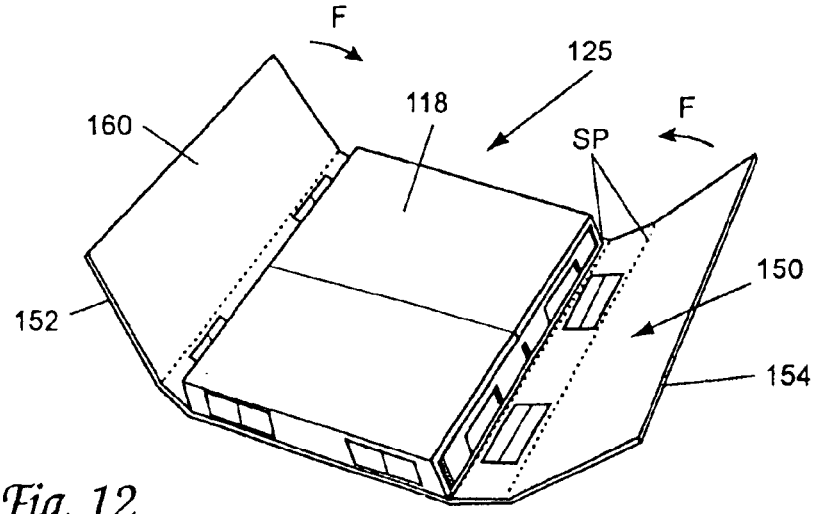
FIG. 12 depicts the wrapping of the outer skin blank about the inner skin blank.
Figure 13:
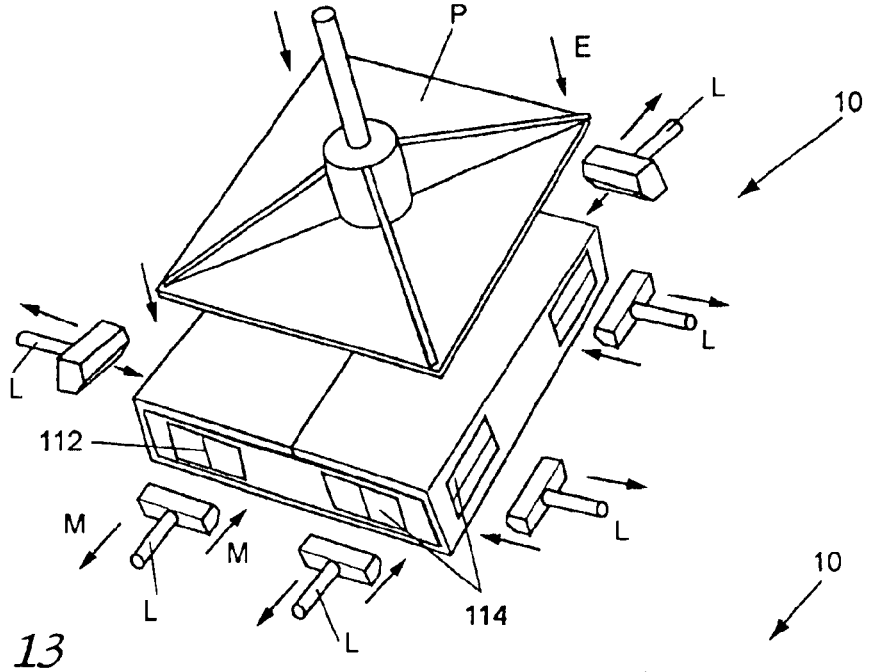
FIG. 13 shows the pressing step that secures the outer flaps, along with the anvils that open the apertures on the end regions.
Figure 15:
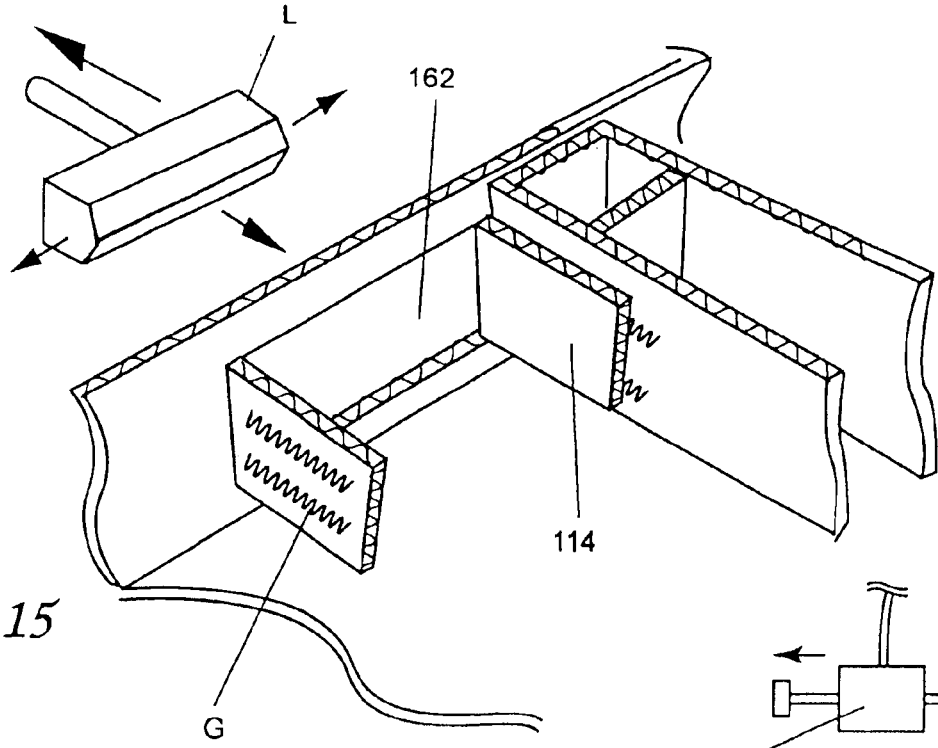
FIG. 15 is view of an anvil that opens the tabs of an aperture and secures them to interior side walls of the pallet, forming wear cuffs.
Figure 15A:
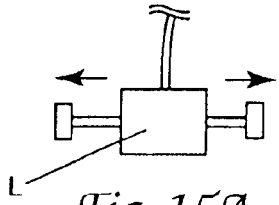
FIG. 15A shows a detail of the anvil of FIG. 15.
Figure 16:
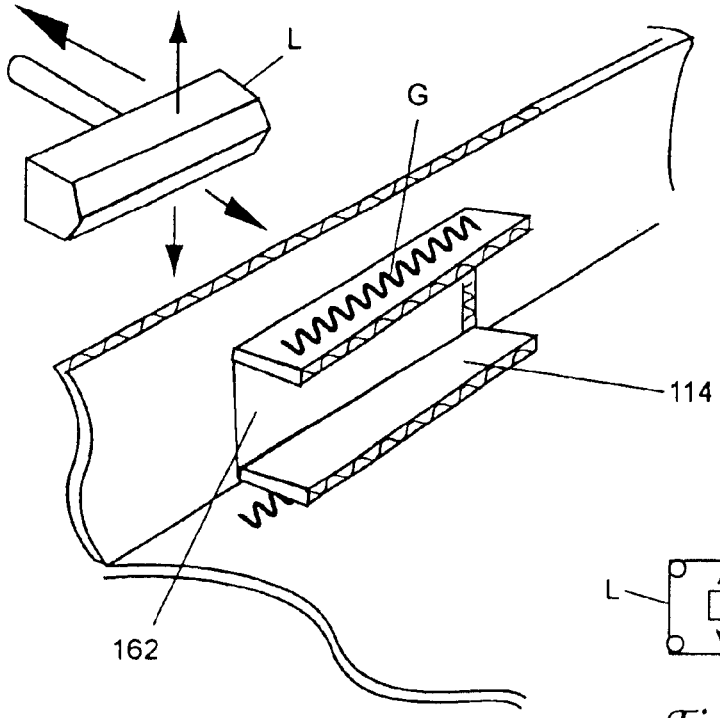
FIG. 16 is a view of an anvil that opens the tabs of an aperture and secures them to interior and bottom walls of the pallet, forming wear cuffs.
Figure 16A:
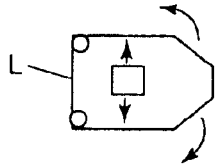
FIG. 16A shows a detail of the anvil of FIG. 16.

Glue G is applied to the bottom region 156 of the outer skin blank 150 and to the area containing the tabs 114 as well as the flaps 160. The inner box 125 is rotated 90° and placed on the bottom region 156 such that the inner flaps 118 and the outer flaps 160 are perpendicular to each other, pictured in FIG. 12. The edges of the inner box 125 are coextensive with the edges of the bottom region 156. The outer blank 150 is then folded in the direction of the arrows "F" around the inner box 125 along the score lines SP, forming a pallet 10. A press or platen P is used to secure (arrow "E") the outer flaps 160 into place as shown in FIG. 13 preferably with glue. Anvils L, also shown in FIG. 13, punch through the cuts 112 on all ends of the pallet 10, to form the apertures 162, shown in FIG. 14. The anvils may simply punch through the cuts 112 along arrow "M", or they may engage in an expanding, compound motion once inside the pallet, pushing the tabs to adjacent walls, by both punching through the cuts 112 and utilizing a mechanism that either pushes the ends of the anvil out to the sides, as shown in FIG. 15 and FIG. 15A, or a hinged mechanism that allows the anvil's top and bottom to swing out, as shown in FIG. 16 and FIG. 16A, to secure the tabs 114, formed from the cuts 112, to the interior panels of the pallet 10. The orientation of the cuts 112 determines the motion of the anvil A.

Note FIG. 15 denotes tabs each of which fold about a vertical line, while FIG. 16 denotes tabs each of which fold about a horizontal line. This allows locating the wear cuff along top or side edges of the aperture, as needed.

The apertures 162 work in conjunction with the clearance passages 78 on stringers and ribs to allow a forklift to pick up and carry the pallet 10 the same way as it would handle a conventional wooden pallet. The folded tabs 114 function as a wear cuff to prevent wear on the apertures 162 from extended forklift use. The four holes 108 from each skin 100, 150 align and register in the completed pallet 10 and provide wheel clearance for pallet-moving equipment other than forklifts (e.g., "pallet jacks").

Figure 17:
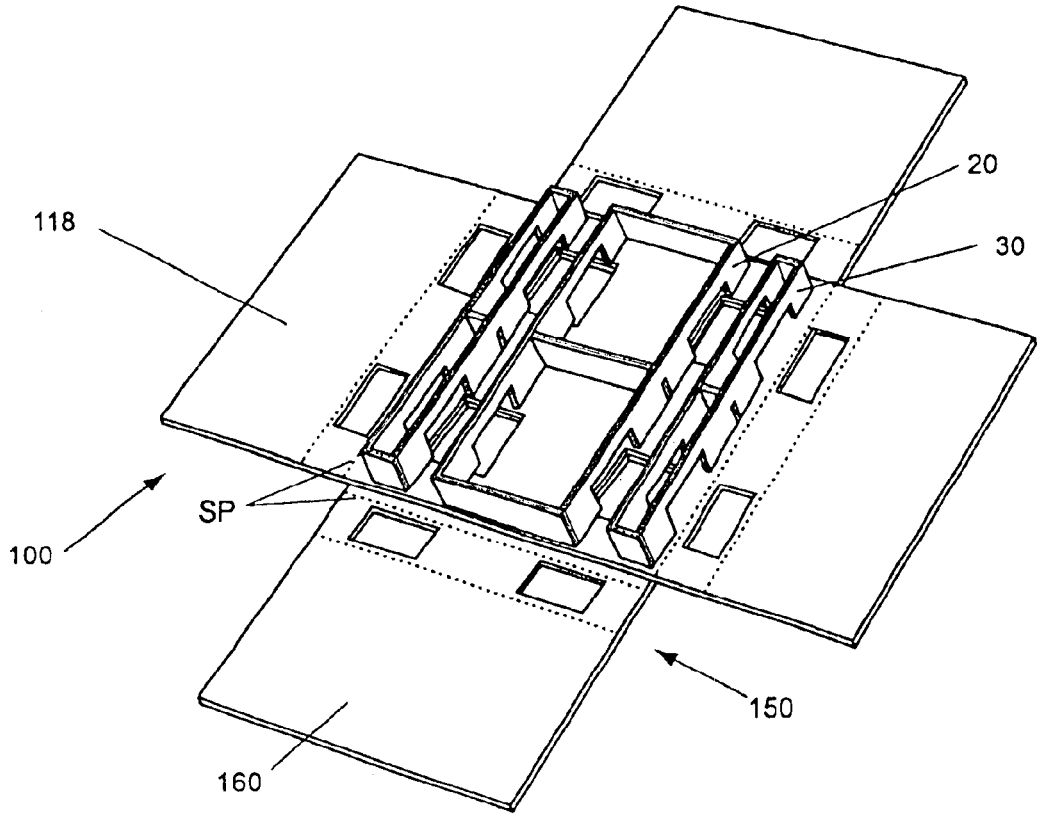
FIG. 17 shows a composite view of the assembly of the pallet.
Figure 18:
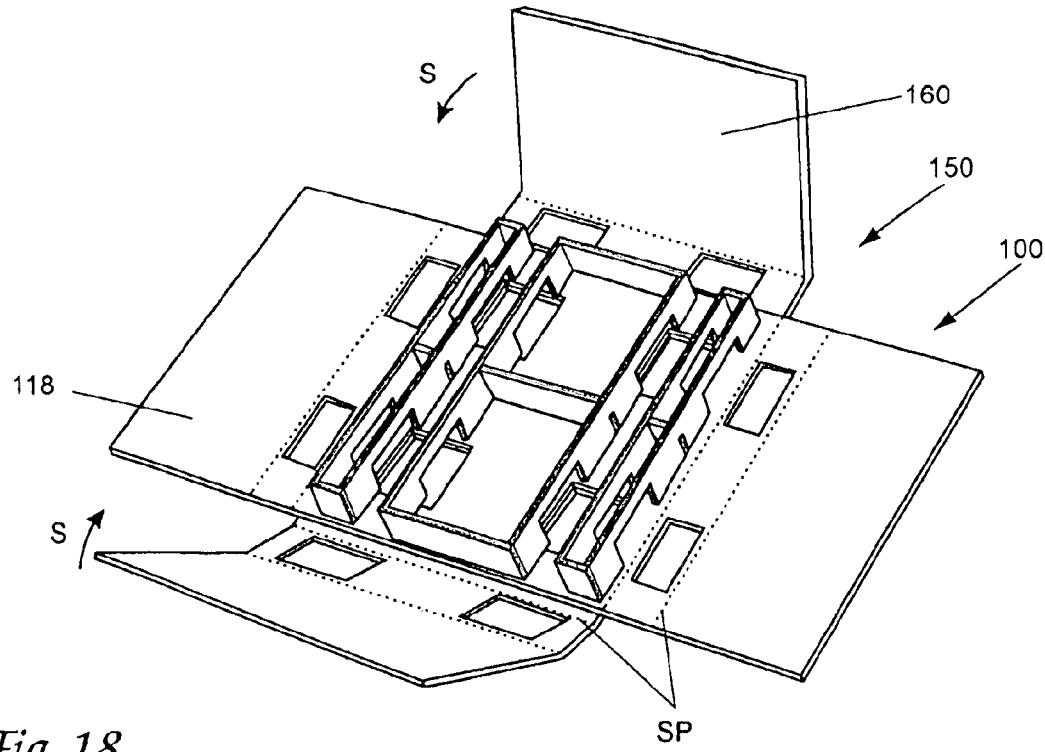
FIG. 18 shows an alternate embodiment of the pallet, in which the outer flaps are wrapped about the stringers and ribs first, and then the inner flaps are so wrapped.

FIGS. 1 and 8 show the stringers and ribs addressing the inner skin 100 in two, alternative different relationships, (i.e., at 98 degrees to each other). In another alternate embodiment, shown in FIGS. 17 and 18, the stringers 20 and ribs 30 are positioned on the center region 106 of the inner skin blank 100 (either as per FIGS. 1 or 8), which is then rotated 90° and positioned on the bottom region 156 of the outer skin blank 150. The outer flaps 160 of the outer skin 150 are then first wrapped along the score lines SP in the direction of the arrows "S" about the center region 106 containing the ribs 20 and stringers 30. Second, the inner flaps 118 are then wrapped along the score lines SP to form the pallet 10. This provides a form of "interleaving" the two skins 100, 150.

Furthermore, it is known that cardboard has a "grain" which is directional resistance to folding in one direction (i.e., perpendicular to its "grain"). For example, assume the "grain" (actually a serpentine core or corrugation within the cardboard) of inner skin 100, FIG. 1 runs parallel to the long axis 102. It is easier to bend (fold) skin 100 longitudinally then latitudinally. It is preferred that the "grain" of outer skin 150 is also parallel to its long axis, making a formed pallet bi-directionally resistant to bending, because the grains between the adjacent inner and outer skins are offset 90 degrees. It is also possible to have the grains 90 degrees "shifted" on each skin (i.e., running latitudinally) but it is still preferred adjacent skins are mutually perpendicular.

Figure 19:
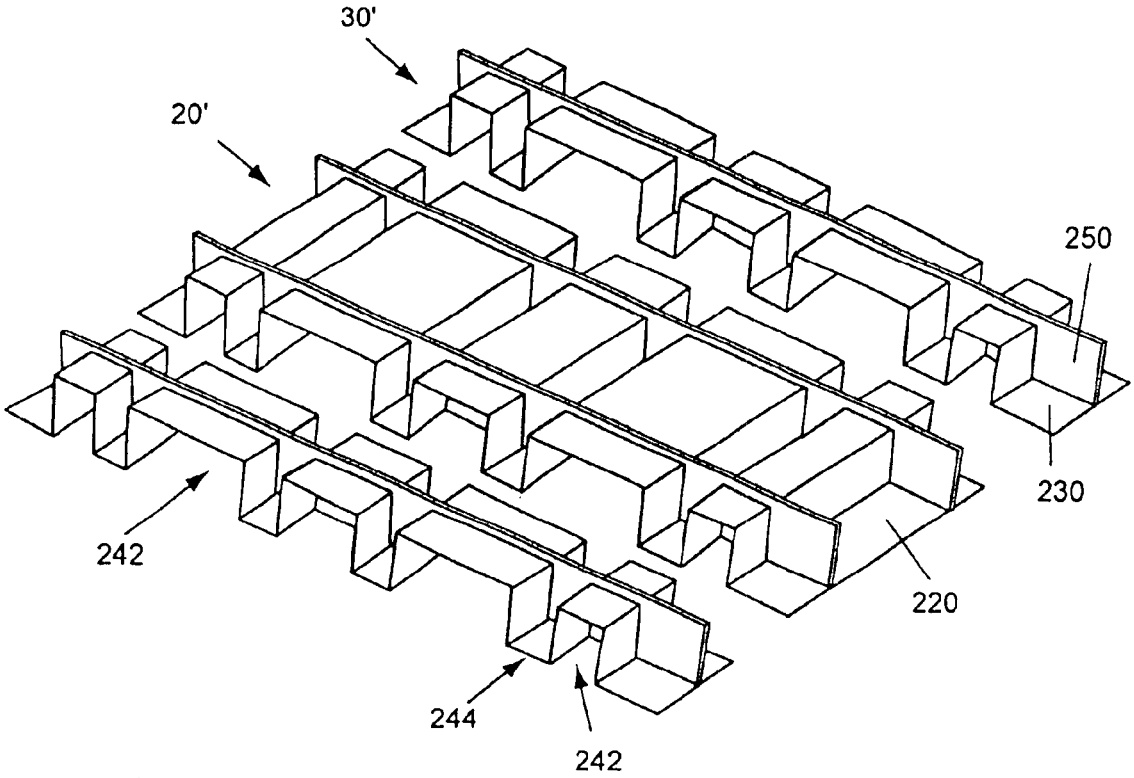
FIGS. 19, 20, 21 show views of an alternative embodiment.
Figure 20:
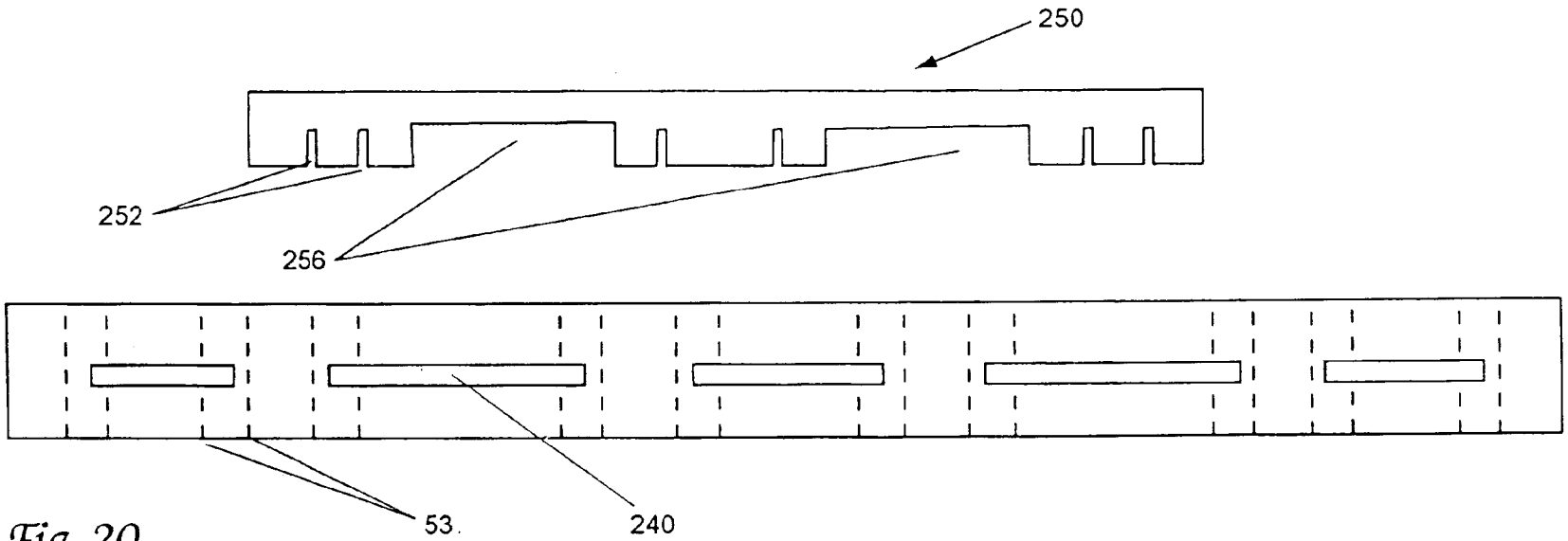
Figure 21:
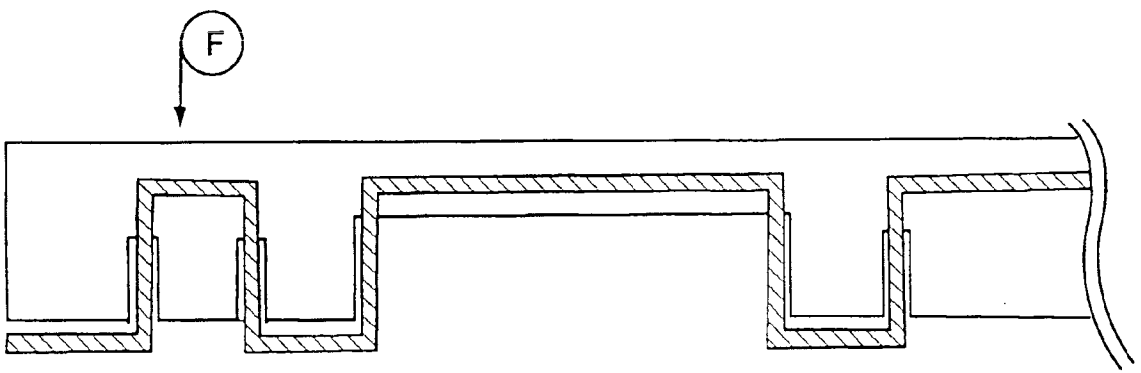

FIGS. 19–21 depict an alternative embodiment of the stringers 20' and ribs 30'. A cardboard sheet is subjected to a die-cut method in which score lines SB are formed to ultimately produce rib blanks 220 and stringer blanks 230 having locking spaces 240, and locking strips 250. The scores lines SB are parallel to the short axis of the blanks 220,230. Each rib blank 220 and stringer blank 230 has length L along its longitudinal axis and several longitudinal locking spaces 240 running along the length L. A rib blank 220 contains one such set of longitudinal locking spaces 240 to divide it into two let portions, while a stringer blank 230 has two sets that divide it into three portions.

Each blank 220,230 is creased and folded along score lines SB to form support pieces having a crenellated surface. With reference to FIG. 19, crenels 242 and merlons 244 are defined. Two large crenels 242 are flanked by three smaller crenels 244, separated by merlons 244. The large crenels 242 are spaced to receive forklift tines and are oriented to coincide with the apertures 162 of the pallet 10.

Each locking strip 250 contains several notches 252 to engage the locking spaces 240 in each blank 220,230 (FIGS. 20,21), which produce teeth 254, preferably three, and two fenestrations 256 corresponding to the large crenels 242 in the folded blanks 220,230 and to the apertures 162 of the pallet 10. The locking strip 250 is inserted into the locking spaces 240 after the blank 220,230 is folded to add support and to ensure that the ribs 20' and stringers 30' retain their shape. The teeth 254 add stability to compensate for the presence of the fenestrations 256 that accommodate the forklift tines. As shown in FIG. 21, the terminus of each end of the locking strip 250 orients squarely with the terminus of the blank 220,230. The terminal ends of each stringer 20' and rib 30' contact the sidewalls of the interior of the pallet 10 after formation of the pallet 10 is complete.

After formation, application of glue G to this embodiment of ribs 20' and stringers 30' occurs as for the ribs 20 and stringers 30 in the other embodiment, described above. The large flat areas of the ribs 20' and stringers 30' provide surface area for bonding. The ribs 20' and stringers 30' are installed in the pallet 10 as in the embodiment described above.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A pallet comprising, in combination:

an inner rectangular blank, and an outer rectangular blank, said inner and outer rectangular blanks orthogonally related, said outer blank directly and substantially overlying said inner blank upon assembly, whereby overlapping areas of said inner and outer blanks with one another provide two plies on top and bottom portions of said pallet.

2. The pallet of claim 1 wherein said inner and outer rectangular blanks are composed of a laminate.

3. The pallet of claim 2 wherein a long axis of one of said inner and said outer rectangular blanks is perpendicular to a long axis of the other.

4. The pallet of claim 3 wherein stringers overlie said inner blank and are enveloped by said outer blank.

5. The pallet of claim 4 wherein said stringers are composed of a laminate.

6. A pallet comprising, in combination:

an inner blank, an outer blank, and a stringer blank, said stringer blank including cutouts and scorelines adapted to conform to stringers disposed upon said inner blank and subsequently enveloped by said inner blank, and then said outer blank, whereby said stringers are completely enveloped by said inner blank and said outer blank.

7. The pallet of claim 6 wherein said inner and outer blanks and said stringer blank are composed of a laminate.

8. A method for forming a pallet, the steps including:

forming a stringer blank to define stringers, forming an inner blank and an outer blank, said inner blank and said outer blank having flaps, said inner blank and said outer blank to register such that said flaps of said inner blank are offset from flaps of said outer blank, and assembling said stringers to lie within said inner blank and then said outer blank, whereby said stringers are completely enclosed by an intersection of said flaps of said inner blank with said flaps of said outer blank.

9. The method of claim 8 wherein said stringer blank includes forming cutouts and scorelines adapted to conform to stringers.

10. The method of claim 9 including composing said inner and outer blanks and said stringer blank of a laminate.

11. The method of claim 8 including orienting a long axis of one of said inner and said outer rectangular blanks perpendicular to a long axis of the other.

12. The method of claim 11 including forming said inner and outer blank cutouts and scorelines to receive protrusions emanating from material handling devices.

13. The method of claim 12 include placing said scorelines on said inner and outer blanks to define a center region, end regions, and said flaps.

14. The method of claim 13 including orienting the cutouts on said outer and inner blanks to include a plurality of portals, said plurality of portals positioned in said center region on said inner and outer blanks so as to coincide when said inner and outer blanks are orthogonally oriented.

15. The method of claim 14 including positioning said plurality of portals on said inner and outer blanks such that diagonals across said center region bisect said plurality of portals diagonally.

16. The method of claim 15 include forming on said inner and outer blanks apertures along said end region, said apertures discretely spaced and dimensioned to receive the tines of a forklift.

17. The method of claim 16 include placing said apertures to define tabs cut into said inner and outer blanks into said end regions, said tabs forming wear cuffs when punched into the pallet to form said apertures.

18. The method of claim 17 including positioning said stringers on said inner blank parallel to a long axis of said inner blank.

19. The method of claim 18 including positioning said stringers about said plurality of portals such that no overlap occurs between said stringers and said plurality of portals.

20. The method of claim 19 include first wrapping said flaps of said inner blank about said stringers, and then wrapping said flaps of said outer blank about said inner blank.

21. The method of claim 19 including wrapping said flaps of said outer blank about said stringers on said inner blank, and then wrapping said flaps of said inner blank about said outer blank.

22. The pallet of claim 16 including cutting said apertures directly into said end regions, without forming tabs or wear cuffs.

23. The method of claim 22 including positioning said stringers on said inner blank parallel to a long axis of said inner blank.

24. The method of claim 23 including positioning said stringers about said plurality of portals such that no overlap occurs between said stringers and said plurality of portals.

25. The method of claim 24 including wrapping said flaps of said inner blank first about said stringers, and then wrapping said flaps of said outer blank about said inner blank.

26. The method of claim 24 including wrapping said flaps of said outer blank about said stringers on said inner blank, and then wrapping said flaps of said inner blank about said outer blank.

27. The method of claim 8 including forming on said stringer blank cutouts and scorelines adapted to conform to said stringers.

28. The method of claim 27 including forming said inner and outer blanks and said stringer blank of a laminate.

29. The method of claim 8 including positioning said stringers on said inner blank parallel to a long axis of said inner blank.

30. The method of claim 29 including positioning said stringers about a plurality of portals, said plurality of portals positioned on said inner and outer blanks so as to coincide when said inner and outer blanks are orthogonally oriented, such that no overlap occurs between said stringers and said plurality of portals.

31. The method of claim 30 including wrapping said flaps of said inner blank first about said stringers, and then wrapping said flaps of said outer blank about said inner blank.

32. The method of claim 30 including wrapping said flaps of said outer blank about said stringers on said inner blank, and then wrapping said flaps of said inner blank about said outer blank.

33. A method for constructing a pallet, the steps including:

forming two rectangular blanks, arranging said rectangular blanks in a cruciform pattern, said pattern including an overlapping portion and flaps, attaching stringers to said overlapping portion of said cruciform pattern formed by said rectangular blanks, parallel to the long axis of one of said rectangular blanks, wrapping said flaps of said blanks about the stringers, whereby said stringers are completely enclosed by said flaps, securing said wrapped flaps of the pallet, and punching apertures into the end portions of the pallet.

34. The method of claim 33 including forming said rectangular blanks with a plurality of portals adapted for certain material-handling devices, said plurality of portals positioned said rectangular blanks so as to coincide when said rectangular blanks are arranged in said cruciform pattern.

35. The method of claim 34 including forming said rectangular blanks with tabs defining apertures dimensioned for forklift tines.

36. The method of claim 35 including punching said apertures into the pallet such that said tabs are pushed into the pallet and secured to interior side surfaces of the pallet, forming wear cuffs.

37. The method of claim 36 including punching said apertures into the pallet such that said tabs are pushed into the pallet and secured to interior top and bottom surfaces of the pallet, forming wear cuffs.

38. The method of claim 37 including attaching said flaps of said blank attached to said stringers about said stringers first.

39. The method of claim 37 including wrapping said flaps of said blank not attached to said stringers about said stringers first.

40. The method of claim 33 including wrapping said flaps of said blank attached to said stringers about said stringers first.

41. The method of claim 33 including wrapping said flaps of said blank not attached to said stringers about said stringers first.

42. A pallet, comprising, in combination:

an outer blank having a body portion and end flaps;

an inner blank perpendicularly disposed on said outer blank, said inner blank having a body portion and end flaps; and a plurality of stringers disposed on said inner blank and enveloped by the end flaps of said outer blank and said inner blank, whereby said stringers are completely enclosed by said inner blank and said outer blank.

43. The pallet of claim 42 wherein said inner blank, said outer blank, and said plurality of stringers each contain discretely-spaced apertures to accommodate the tines of a forklift.

44. The pallet of claim 43 wherein said stringers are present in a plurality of sizes.

45. The pallet of claim 44 wherein said stringers are composed of a support piece and a lateral locking strip.

46. The pallet of claim 45 wherein grooves to receive said lateral locking strip are present in said support piece and are parallel to its long axis.

47. A method of forming a pallet, the steps including:

forming an outer blank, an inner blank, and a plurality of stringers;

orienting said inner blank on said outer blank;

placing said plurality of stringers on said inner blank; and enveloping said plurality of stringers with said inner blank and said outer blank, whereby said plurality of stringers is completely enclosed by said inner blank and said outer blank.

48. The method of claim 47 further including the step of creating apertures in said inner blank, said outer blank, and said plurality of stringers, said apertures discretely-spaced to receive the tines of a forklift.

49. An improvement for a pallet, the improvement comprising:

a stringer for a pallet interior, comprising, in combination:

a support piece having a plurality of notches, and a plurality of locking strips, said locking strips inserted in said notches on said support piece and said locking strips parallel to a long axis of said stringer.

50. The improvement of claim 49, wherein said support piece further comprises crenels and merlons along the surface of said support piece.

51. The improvement of claim 50 wherein said each said locking strip has a profile complemental to said crenels and merlons in said support piece.

52. The improvement of claim 51 wherein said crenels and merlons include discretely-spaced apertures to accommodate the tines of a forklift.

53. The improvement of claim 49 wherein each of said plurality of locking strips has a length equal to said long axis of said stringer after said plurality of locking-strips is inserted into said support piece.

54. The pallet of claim 46 wherein said lateral locking strip has a length equal to the long axis of said stringer after said lateral locking strip is received in said grooves of said support piece.

55. The pallet of claim 54 wherein said lateral locking strips are oriented perpendicularly to said body portions of said inner and said outer blanks.

56. A pallet, comprising, in combination:

an outer blank having a body portion and end flaps;

an inner blank perpendicularly disposed on said outer blank, said inner blank having a body portion and end flaps; and a plurality of stringers disposed on said inner blank and enveloped by the end flaps of said outer blank and said inner blank, each of said stringers comprising, in combination: a plurality of lateral locking strips and a support piece, said support piece having a plurality of grooves to receive said plurality of lateral locking strips.

57. The pallet of claim 56 wherein each said lateral locking strip has a length equal to the long axis of said stringer after each said lateral locking strip is received in said plurality of grooves of said support piece.

58. The pallet of claim 57 wherein a short axis of said lateral locking strips is oriented perpendicularly to said body portions of said inner and said outer blanks.

* * * * *